US005113766A

United States Patent [19]

Grosch

[11] Patent Number: 5,113,766

[45] Date of Patent: May 19, 1992

[54] MINE CONTROL DEVICE

[75] Inventor: Hermann Grosch, Wülfrath, Fed. Rep. of Germany

[73] Assignee: Rheinmetall GmbH, Düsseldorf, Fed. Rep. of Germany

[21] Appl. No.: 709,366

[22] Filed: Jun. 3, 1991

[30] Foreign Application Priority Data

Aug. 14, 1990 [DE] Fed. Rep. of Germany ..... 4025680

[51] Int. Cl.[5] ..... F42C 11/04; F42C 17/04

[52] U.S. Cl. ..... 102/427; 89/6.5; 102/206; 102/420

[58] Field of Search ..... 102/427, 416, 420, 401, 102/206, 221; 89/6.5, 6, 1.55

[56] References Cited

U.S. PATENT DOCUMENTS

| | | | |
|---|---|---|---|
| 2,967,481 | 1/1961 | Semon et al. | 102/420 |
| 3,937,124 | 2/1976 | Krumes | 102/427 |
| 4,730,794 | 3/1988 | Knauer | 102/427 |
| 4,799,429 | 1/1989 | LaBudde et al. | 102/206 |

FOREIGN PATENT DOCUMENTS 3843476 10/1989 Fed. Rep. of Germany .

*Primary Examiner*—David H. Brown

*Attorney, Agent, or Firm*—Spencer, Frank & Schneider

[57] ABSTRACT

An arrangement for programming the control of a mine including a pin (16) made of a material having a predeterminable magnetic permeability and inserted into a blind bore-like opening in a mine housing (12). Via a coil disposed in the interior of the mine and surroundng the blind bore-like opening, a resonant output frequency $f_R$) of an oscillator, which frequency is a function of the permeability of the pin (16), is generated. If the detected resonant output frequency ($f_R$) corresponds to a frequency ($f_i$) stored in a frequency/address memory (42), an address ($A_i$) associated with this frequency ($f_i$) is read out and fed to a read-only memory (44). This determined address ($A_i$) causes information ($I_i$) associated with this address ($A_i$) in the information memory (44) to be read out so that the action belonging to the respective information ($I_i$) is initiated within the mine.

13 Claims, 1 Drawing Sheet

MINE CONTROL DEVICE

BACKGROUND OF THE INVENTION

The present invention relates to a mine control device. More particularly the present invention relates to an arrangement wherein the detonation and safety device of an explosive mine can be programmed via an electronic unit which is disposed in the interior of the mine housing and which is controllable from outside the mine housing.

In order to increase tactical flexibility during the use of prior art mines of this type, it is necessary to preset their active or waiting time before they are laid. To increase the efficiency of a mine barrier established with such mines, it is further desirable to feed into the mine or mines, before they are laid, parameters regarding their response behavior upon the detection of a target or during mine sweeping measures. Such data are customarily transmitted to and fed in manually or without contact to each mine during the laying process or when they are activated.

German Patent No. 3,843,476 discloses a device for the inductive, non-contact programming of a mine by means of a programming device. In this device, a so-called programming finger composed of a magnetic core and a transmitting coil surrounding the core is inserted into a blind bore-like opening in a mine housing. Via a receiving coil, which surrounds the blind bore in the interior of the mine and which is connected with an electronic unit in the mine, it is possible to inductively couple the programming device to the mine itself so that energy and data can be transferred in this way from the programming device to the electronic detonation and safety unit provided in the mine.

Since, in the device according to German Patent No. 3,843,476, extraneous (interfering) magnetic fields are to be without influence on the receiving coil in the interior of the mine, the use of a programming device is absolutely necessary to program one or several mines. However, due to the high costs of such programming devices, they are not always available in any desired number at the location of use. Consequently, upon the malfunction of a programming device, possibly during a programming process that has not yet been completed, no further mine or mines can be programmed until a new operational programming device is available.

SUMMARY OF THE INVENTION

It is therefore an object of the invention to provide an easily manipulated, economical device for the programmed control of mines while avoiding the expensive programming device.

The above object generally is achieved according to the present invention by an explosive mine which comprises: a mine housing having an exterior wall with an inwardly directed projection provided with a blind bore-like opening extending into the projection from an outer surface of the wall; a programmable detonation and safety control unit disposed in the mine housing; a pin having a predetermined desired magnetic permeability removeably disposed in the opening; and electronic circuit means, disposed within the mine housing and controllable by the magnetic permeability of the pin, for programming the detonation and safety control unit, with the circuit means including a read-only memory having its output connected to the detonation and safety device and containing a plurality of digital informations, each stored at a fixed different address, for programming the detonation and safety control unit, a variable oscillator having an oscillator resonant frequency determining coil, with the coil surrounding at least a portion of the extension, whereby the inductance of the coil is a function of the permeability of the pin, and further circuit means, responsive to the output frequency of the oscillator, for producing an address signal for the read-only memory corresponding to the particular output frequency of the oscillator, and for feeding the address signal to the read-only memory to cause the information stored at the address to be read out and program the detonation and safety control unit.

Preferably, the further circuit means includes a frequency to voltage converter connected to the output of the oscillator for producing an analog output voltage corresponding to the output frequency of the oscillator, an analog to digital converter, connected to the output of the frequency to voltage converter, for converting the analog output voltage to a digital signal corresponding to the output frequency, and a frequency to address memory for producing a particular address signal for the read-only memory corresponding to a particular value of the output frequency of the oscillator.

The particular advantage of the arrangement according to the invention lies in that all data required for controlling the mine are already available in the mine as individual information, and the simple insertion of a small pin enables the desired individual information to be called up directly and reliably.

The pins themselves may be carried in large numbers by each individual operator so that a few operators, possibly operating in parallel, are able to program a large number of mines within a short period of time.

As an advantageous feature of the invention, the pin according to the invention can be manufactured very easily so that mass production is also possible. Since, according to the invention, the desired characteristics of the pin can be set directly by the material composition and/or its geometry, many possible configurations are available at low manufacturing costs.

As an additional advantageous feature of the invention, an arrangement is provided whereby the pin can be reliably retained in the mine for a desired period of time.

The invention will be explained and described below in greater detail with reference to the drawing figures.

DETAILED DESCRIPTION OF THE PREFERRED EMBODIMENT

Figure 1:
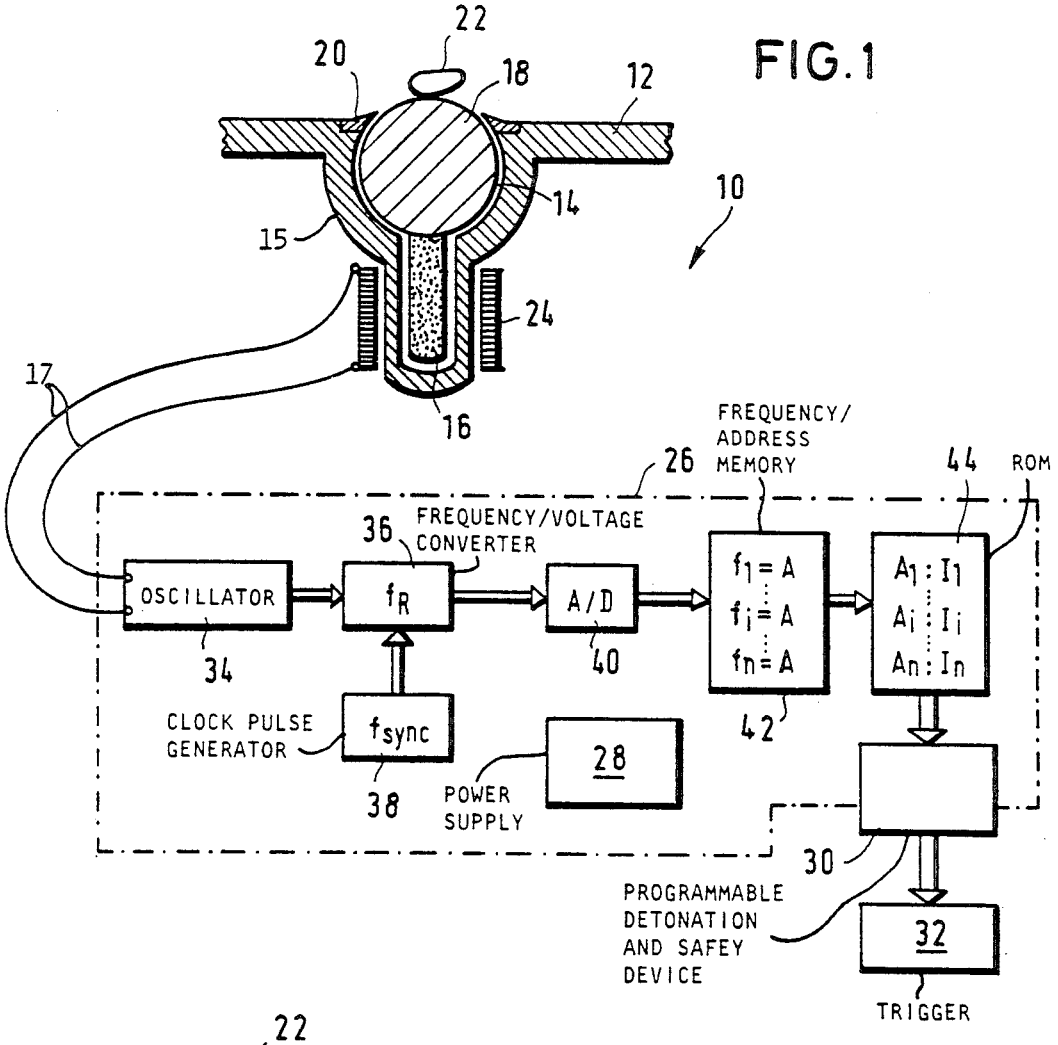
FIG. 1 is a schematic illustration, including a schematic representation of an electronic circuit, of a preferred embodiment of the device according to the invention.

Turning now to FIG. 1, there is shown a device 10 for the control of mines which includes a blind bore-like opening 14 provided in an inwardly extending projection 15 of an exterior wall of a mine housing 12 and serving to accommodate a pin 16 and a ball 18 fastened to the pin 16. The blind bore-like opening 14 is adapted in its outline shape or contour to the outline of pin 16 and the ball 18 fastened thereto, with ball 18 being accommodated almost completely in the blind bore-like opening 14. In order to hold pin 16 and its ball 18 fastened thereto in the blind bore-like opening 14, a holding collar 20, preferably made of an elastic material, is provided as an arresting means on the outer surface of the housing wall 12 in the exit region of the blind bore-like opening 14. To ensure easy removal, if desired, of pin 16 and ball 18 fastened thereto from the blind bore-like opening 14, a string or other gripping device 22 is attached to the ball 18 at a position so that it extends out of the opening 14.

In the interior of mine housing 12, at least the portion of the projection 15 into which pin 16 extends is surrounded by a coil 24. This coil 24 is connected by electrical connections 17 with an electronic unit 26 likewise provided in the interior of mine housing 12.

Electronic unit 26 includes a power supply 28, for example a battery, and can be activated in a known manner when the mine is laid. This power supply 28 supplies the individual components of electronic unit 26 and also a detonation and safety control unit (ZUSE) 30 partially integrated therein. Moreover, mine housing 12 includes an active unit marked 32 which is triggered by detonation an safety unit 30 to explode the mine. The sensors customarily included in mines for the detonation and safety unit 30 are not the subject of this invention and are therefore not shown.

Electronic unit 26 is composed of an oscillator 34, a frequency to voltage converter 36, a clock pulse generator 38, an analog/digital converter 40, a frequency/address memory module 42, and a read-only memory 44 containing information.

Before the mine is laid, information memory 44 already contains all functions and parameters which may be required during use of the mine once it is laid in the form of information, e.g., blocks of data, $I_i$ to $I_n$. Each individual information $I_i$ ($i=1, \ldots, n$) has an associated fixed address $A_i$ ($i=1, \ldots, n$) so that a desired individual information $I_i$ can be unequivocally addressed in memory 44 and read out.

The invention utilizes the realization that, once a pin 16 has been inserted into the bore 14, the inductance L of coil 24 is the following, in a first approximation:

$$L=\mu_o \cdot \mu_r \cdot n^2 \cdot A \cdot \lambda^{-1}$$

where n is the number of windings of the coil, $\lambda$ is the length of the coil, A is the cross-sectional area of the coil;

$\mu_o$ is the absolute permeability (in a vacuum); and $\mu_r$ is the relative permeability in the interior of the coil, with $\mu_r$ being a function of the permeability of pin 16.

Each pin 16 is manufactured of a material having a predeterminable magnetic permeability and is preferably produced in a sintering process of a mixture of highly permeable and magnetically neutral material.

Since the relative permeability $\mu_r$ approximately linearly enters into the value of the inductance L, precise and discrete inductance values can be set during the manufacture of pin 16 by way of the mixing ratio of magnetically neutral to magnetically highly permeable material, with the volume of the pins 16 remaining constant in each case.

As shown, coil 24 is connected to the oscillator 34 and forms part of the frequency determining resonant circuit of the oscillator 34. Thus, if after laying of a mine provided with the device 10 according to the invention and with a pin 16 having a desired permeability inserted, oscillator 34 is turned on by the power supply 28, after the safety time has expired, the oscillator 34 will produce an output resonant frequency $f_R$ which is a function of the inductance of the coil 24 according to the following equation.

$$f_R=(2\cdot\pi\cdot n)^{-1}\cdot(C\cdot A\cdot\mu_o\cdot\mu_r\cdot\lambda^{-1})^{-\frac{1}{2}}$$

where C is the capacitance of the oscillator resonant circuit and is a constant.

The output frequency $f_R$ of the oscillator 34 is fed to the frequency to voltage converter 36, for example an integrator whose time interval is controlled by the clock pulse generator 38, to produce an analog voltage corresponding to the output frequency $f_R$ of the oscillator 34. This analog output voltage corresponding to the resonant frequency $f_R$ produced by a certain pin 16, that is, by a certain permeability of this pin 16, is converted in a subsequently connected analog/digital converter 40 into a digital signal characteristic of the resonant frequency $f_R$. This digitalized value $f_i$ for the resonant frequency $f_R$ is fed to the frequency/address memory 42 to cause an address $A_i$ of read memory 44 corresponding to the particular value $f_i$ of the resonant frequency $f_R$ to be read out of memory 42 and fed to memory 44 as an address.

With the aid of this address $A_i$ which belongs to a certain value of resonant frequency $f_R$, the information $I_i$ belonging to this address $A_i$ in information memory 44 can be found and read out to the detonation and safety control unit 30 to program same and initiate the action defined by the addressed information $I_i$ within the mine.

Figure 2A:
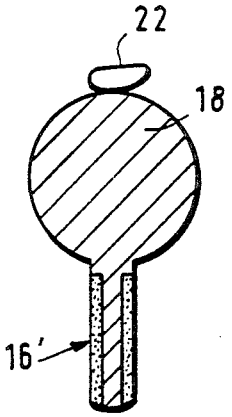
FIGS. 2*a* and 2*b* each show a further embodiment of a pin according to the invention.
Figure 2B:
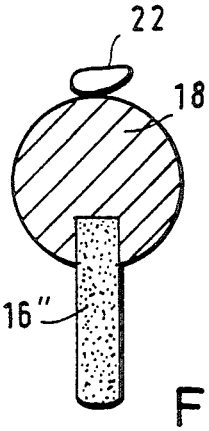

FIGS. 2a and 2b show further embodiments of the pin 16 according to the invention, to illustrate the many possibilities for the configuration of such a pin 16.

In addition to the already mentioned possibility of setting the desired magnetic permeability of pin 16 by appropriately configuring its material as a mixture of highly permeable and magnetically neutral materials, it is also possible to set the desired permeability by a variation in the geometry of the permeable layer. For example, FIG. 2a shows a pin 16' having a low desired permeability by providing the magnetic permeability layer with a tubular configuration about the remaining portion of the pin. FIG. 2b, however, shows an arrangement with a larger permeable region or pin 16'' compared to pin 16 of FIG. 1 so that in this way a pin can be produced which has a greater permeability.

Ball 18 and pin 16 may be finished completely in one manufacturing phase or, if manufactured separately, may be assembled and connected with one another in a known manner. Ball 18 is preferably formed of a non-magnetic or magnetically neutral material.

The invention now being fully described, it will be apparent to one of ordinary skill in the art that any changes and modifications can be made thereto without departing from the spirit or scope of the invention as set forth herein.

What is claimed is:

1. An explosive mine comprising: a mine housing having an exterior wall with an inwardly directed projection provided with a blind bore-like opening extending into said projection from an outer surface of said wall; a programmable detonation and safety control unit disposed in said mine housing; a pin having a predetermined desired magnetic permeability removeably disposed in said opening; and electronic circuit means, disposed within said mine housing and controllable by the magnetic permeability of said pin, for programming said detonation and safety control unit, said circuit means including a read-only memory having its output connected to said detonation and safety control unit and containing a plurality of digital informations, each stored at a fixed different address, for programming said detonation and safety control unit, a variable oscillator having an oscillator resonant frequency determining coil, with said coil surrounding at least a portion of said projection, whereby the induction of said coil is a function of the permeability of said pin, and further circuit means, responsive to the output frequency of said oscillator, for producing an address signal for said read-only memory corresponding to the particular output frequency of said oscillator, and for feeding said address signal to said read-only memory to cause the information stored at the address to be read out and program said detonation and safety control unit.

2. A mine as defined in claim 1 wherein said further circuit means includes: a frequency to voltage converter connected to the output of said oscillator for producing an analog output voltage corresponding to the output frequency of said oscillator; an analog to digital converter, connected to the output of said frequency to voltage converter, for converting the analog output voltage to a digital signal corresponding to the output frequency; and a frequency to address memory for producing a particular address signal for said read-only memory corresponding to a particular value of said output frequency of said oscillator.

3. A mine as defined in claim 1, further comprising elastic means, disposed at said opening, for retaining said pin in said opening.

4. A mine as defined in claim 1, wherein said pin is attached to a ball, and said opening is configured to accommodate said pin and substantially all of said ball.

5. A mine as defined in claim 4, further comprising elastic means disposed around said opening at the outer surface of said opening for retaining said pin and said ball in said opening.

6. A mine as defined in claim 4, further comprising means, attached to said ball and extending beyond the outer surface of said wall, for facilitating removal of said pin from said opening.

7. A mine as defined in claim 1, wherein said pin is a sintered mixture of magnetically highly permeable and magnetically neutral materials.

8. A mine as defined in claim 7, wherein the magnetic permeability of said pin is set by the mixing ratio of permeable to non-permeable material.

9. A mine as defined in claim 8, wherein the magnetic permeability of said pin additionally is set by the geometry of said pin.

10. A mine according to claim 9, wherein said pin includes a tubular layer of magnetically permeability material disposed around a core of non-magnetic material.

11. An explosive mine comprising: a mine housing having an exterior wall with an inwardly directed projection; a blind bore-like opening, which extends into said projection from an outer surface of said wall, for receiving a pin having a predetermined desired magnetic permeability; a programmable detonation and safety control unit disposed in said mine housing; and electronic circuit means, disposed within said mine housing, for programming said detonation and safety control unit, said electronic circuit means including a read-only memory having its output connected to said detonation and safety control unit and containing a plurality of digital informations, each stored at a fixed different address, for programming said detonation and safety control unit according to selectable functions and parameters, a variable oscillator having an oscillator resonant frequency determining coil, with said coil surrounding at least a portion of said projection, whereby the inductance of said coil is a function of the magnetic permeability of a pin disposed in said opening, and further circuit means, responsive to the output frequency of said oscillator, for producing an address signal for said read-only memory corresponding to the particular output frequency of said oscillator, and for feeding said address signal to said read-only memory to cause the information stored at the address to be read out and program said detonation and safety control unit.

12. An explosive mine as defined in claim 11 wherein said further circuit means includes: a frequency to voltage converter connected to the output of said oscillator for producing an analog output voltage corresponding to the output frequency of said oscillator; an analog to digital converter, connected to the output of said frequency to voltage converter, for converting the analog output voltage to a digital signal corresponding to the output frequency; and a frequency to address memory for producing a particular address signal for said read-only memory corresponding to a particular value of said output frequency of said oscillator.

13. An explosive mine as defined in claim 11, further comprising elastic means, disposed at said opening, for retaining a pin in said opening.

* * * * *